US011060755B2

(12) United States Patent
Minor et al.

(10) Patent No.: US 11,060,755 B2
(45) Date of Patent: Jul. 13, 2021

(54) FLOOR AIR DIFFUSER

(71) Applicant: Air Distribution Technologies IP, LLC, Milwaukee, WI (US)

(72) Inventors: Gary A. Minor, Flower Mound, TX (US); Mark J. Costello, Plano, TX (US); Manian A K S, Chennai (IN)

(73) Assignee: Air Distribution Technologies IP, LLC, Milwaukee, WI (US)

( * ) Notice: Subject to any disclaimer, the term of this patent is extended or adjusted under 35 U.S.C. 154(b) by 211 days.

(21) Appl. No.: 16/268,293

(22) Filed: Feb. 5, 2019

(65) Prior Publication Data

US 2020/0248925 A1 Aug. 6, 2020

Related U.S. Application Data

(60) Provisional application No. 62/800,940, filed on Feb. 4, 2019.

(51) Int. Cl.

| | |
|---|---|
| ***F24F 13/10*** | (2006.01) |
| ***F24F 13/00*** | (2006.01) |
| ***F24F 13/06*** | (2006.01) |

(52) U.S. Cl.

CPC ..... *F24F 13/06* (2013.01); *F24F 13/105* (2013.01)

(58) Field of Classification Search

CPC ..... F24F 13/06; F24F 13/068; F24F 13/08; F24F 13/082; F24F 13/10; F24F 2221/40; F24F 11/74; F24F 13/105; F24F 13/12; F24F 13/14; F24F 13/1426

USPC ..... 454/289–290

See application file for complete search history.

(56) References Cited

U.S. PATENT DOCUMENTS

| | | | | |
|---|---|---|---|---|
| 5,938,525 | A * | 8/1999 | Birdsong | F24F 13/065 454/290 |
| 6,083,100 | A * | 7/2000 | Hardy | F24F 13/082 454/290 |
| 6,231,438 | B1 | 5/2001 | Laudermilk | |
| 6,544,117 | B1 | 4/2003 | Hardy | |
| 7,950,988 | B2 | 5/2011 | Demster et al. | |
| 2003/0139133 | A1* | 7/2003 | Hardy | F24F 7/10 454/290 |
| 2006/0246835 | A1* | 11/2006 | Rimmer | F24F 13/105 454/290 |
| 2007/0190927 | A1* | 8/2007 | Bash | F24F 13/105 454/327 |
| 2015/0099456 | A1 | 4/2015 | McQueeny, Jr. et al. | |

OTHER PUBLICATIONS

Price Industries, MFD—Modular Floor Diffuser, Feb. 14, 2017, p. 2. https://www.priceindustries.com/content/uploads/assets/literature/submittals/section%20a/mfd-modular-floor-diffuser-submittal.pdf.

* cited by examiner

*Primary Examiner* — Vivek K Shirsat
*Assistant Examiner* — Ko-Wei Lin
(74) *Attorney, Agent, or Firm* — Fletcher Yoder, P.C.

(57) ABSTRACT

An air diffuser configured to be positioned in a raised floor, in which the air diffuser includes a sleeve having a first end and a second end with an air flow passage extending through the sleeve from the first end to the second end, a diffuser face disposed at the first end of the sleeve and configured to be exposed to an environment in an installed position within the raised floor, a damper disposed at the second end of the sleeve, and a plenum chamber defined within the sleeve between the damper and the diffuser face.

24 Claims, 9 Drawing Sheets

FLOOR AIR DIFFUSER

CROSS REFERENCE TO RELATED APPLICATIONS

This application claims priority from and the benefit of U.S. Provisional Application Ser. No. 62/800,940, entitled "FLOOR AIR DIFFUSER", filed Feb. 4, 2019, which is hereby incorporated by reference in its entirety for all purposes.

BACKGROUND

The present disclosure relates generally to heating, ventilation, and/or air conditioning (HVAC) systems and, specifically, to a diffuser configured to distribute air from the HVAC system.

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Heating, ventilation, and/or air conditioning (HVAC) systems are utilized in residential, commercial, and industrial environments to control environmental properties, such as temperature and humidity, for occupants of the respective environments. The HVAC system may control the environmental properties through control of a supply air flow delivered to and ventilated from the environment. For example, the HVAC system may supply the air flow to a space serviced by the HVAC system via a diffuser. The diffuser may be installed within a floor of the space during operation of the HVAC system. However, a structure of the floor may limit the ability of the diffuser to distribute air into the space.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, an air diffuser is configured to be positioned in a raised floor. The air diffuser includes a sleeve having a first end and a second end with an air flow passage extending through the sleeve from the first end to the second end, a diffuser face disposed at the first end of the sleeve and configured to be exposed to an environment in an installed position within the raised floor, a damper disposed at the second end of the sleeve, and a plenum chamber defined within the sleeve between the damper and the diffuser face.

In another embodiment, an air diffuser is configured to be positioned in a raised floor, in which the air diffuser includes a sleeve having a first end and a second end, a diffuser face disposed at the first end of the sleeve and configured to be exposed to a conditioned space in an installed position within the raised floor, and a damper disposed at the second end of the sleeve and having a plurality of damper sections configured to adjustably block an opening of the second end to regulate a rate of air flow into the sleeve, in which each damper section of the plurality of damper sections is rotatable relative to one another. Furthermore, the air diffuser includes a plenum chamber defined within the sleeve between the damper and the diffuser face.

In another embodiment, an air diffuser is configured to be positioned in a raised floor, in which the air diffuser includes a sleeve having a first end and a second end with an air flow passage extending through the sleeve from the first end to the second end, a diffuser face coupled to the sleeve at the first end, and a damper coupled to the sleeve at the second end to define a plenum chamber within the sleeve between the damper and the diffuser face. The air diffuser further includes a damper connector extending through the plenum chamber and coupled to the damper and to the diffuser face, in which the damper connector is configured to enable adjustment of a position of the damper via rotation of the diffuser face.

DRAWINGS

Various aspects of this disclosure may be better understood upon reading the following detailed description and upon reference to the drawings in which.

Figure 8:
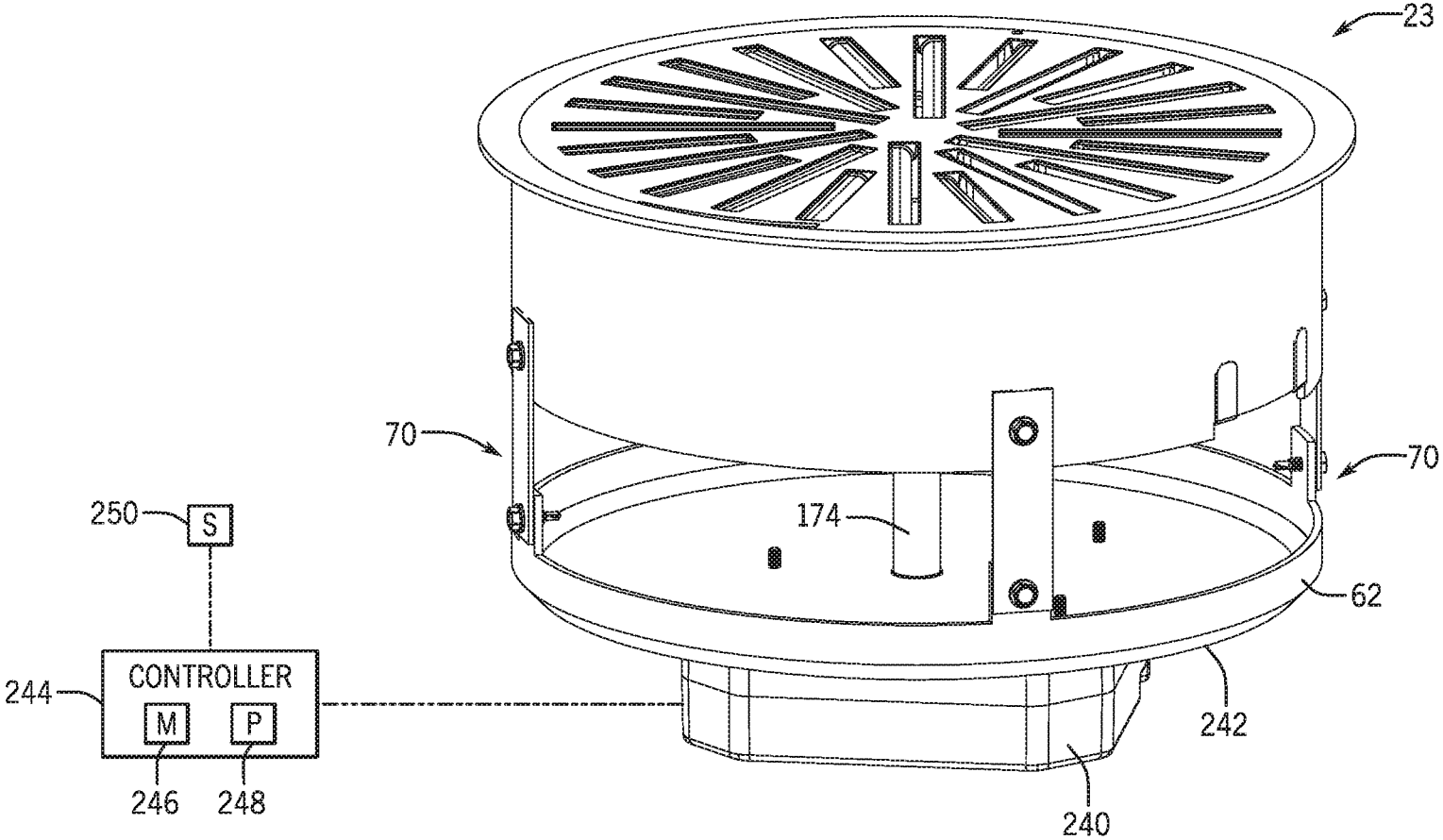
Figure 9:
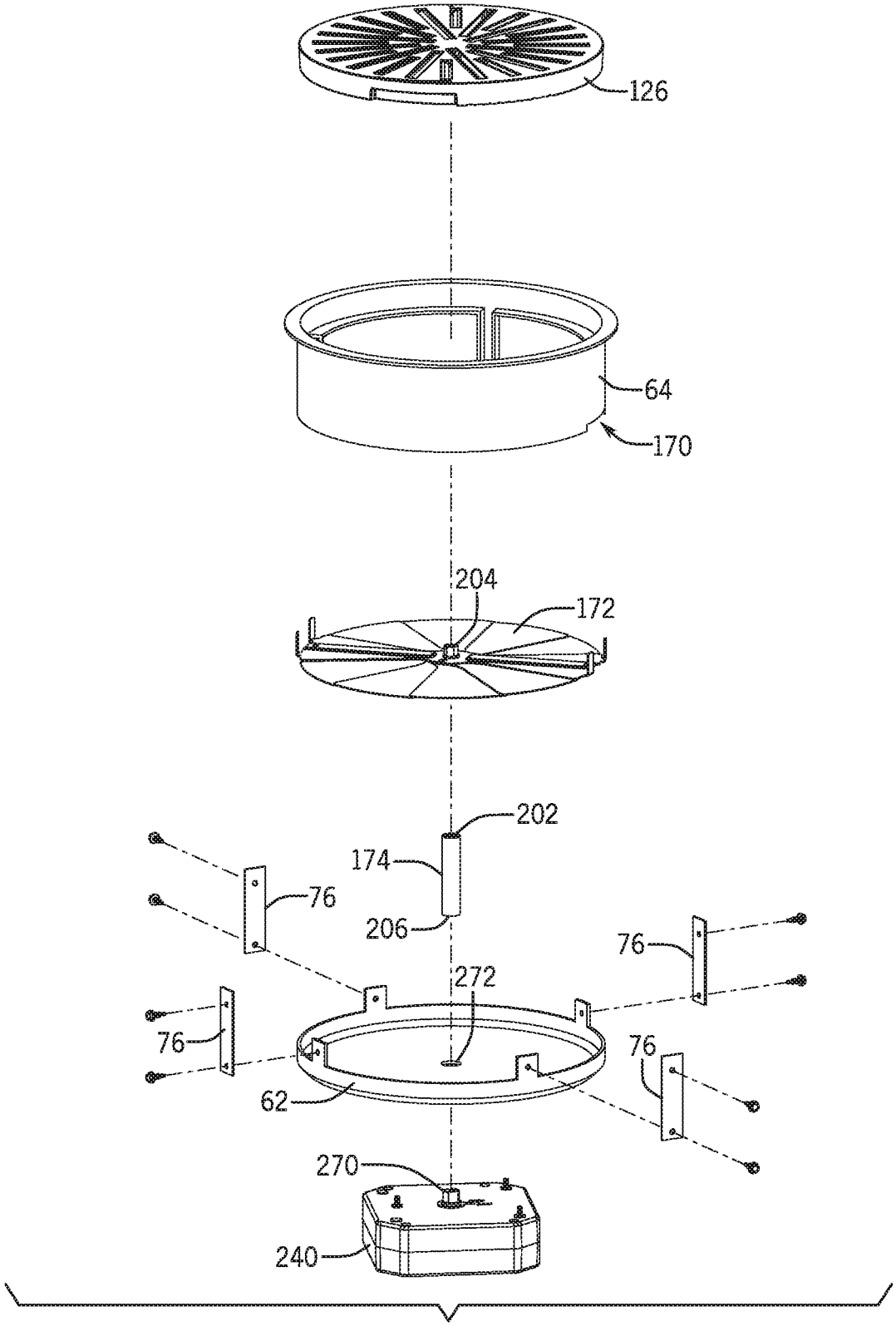

FIG. 8 is a perspective view of an embodiment of an air diffuser configured to be actuated via an actuator to adjust an amount of air flow directed through the air diffuser, in accordance with an aspect of the present disclosure; and FIG. 9 is an exploded perspective view of the air diffuser of FIG. 8 configured to be actuated via the actuator to adjust the amount of air flow directed through the air diffuser, in accordance with an aspect of the present disclosure.

DETAILED DESCRIPTION

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Embodiments of the present disclosure are directed to a diffuser for use with a heating, ventilation, and/or air conditioning (HVAC) system. Disclosed embodiments of the diffuser are configured to be disposed within a floor, such as a raised floor, and are configured to direct air into a space serviced by the HVAC system. For example, the HVAC system may condition an air flow, such as by changing a temperature of the air flow, and the conditioned air flow may be directed through or beneath the floor to the diffuser. The diffuser may then distribute the conditioned air into the space in order to condition the space. In certain traditional diffusers, a structure of the floor may affect the performance of the diffuser. For example, a thickness of a slab of the floor may limit an amount of air flow received by the diffuser beneath the floor, thereby limiting an amount or a rate of air flow discharged by the diffuser. Moreover, a structure of the diffuser may not effectively distribute the air flow across the space. That is, for example, the air flow may not be evenly distributed within the diffuser and, as a result, the air flow may not be evenly distributed when directed out of the diffuser.

It is presently recognized that a diffuser that is not operationally limited by the structure of the floor may improve distribution of air flow discharged by the diffuser. Thus, in accordance with certain embodiments of the present disclosure, the diffuser may include a sleeve that forms an inlet configured to receive an air flow, in which an area of the inlet may not be affected by the structure of the floor. Furthermore, the air flow may be evenly distributed within the plenum chamber to enable more uniform discharge of the air flow from the diffuser. Thus, the diffuser may effectively distribute air into the space and, therefore, improve conditioning of the space serviced by the HVAC system.

Figure 1:
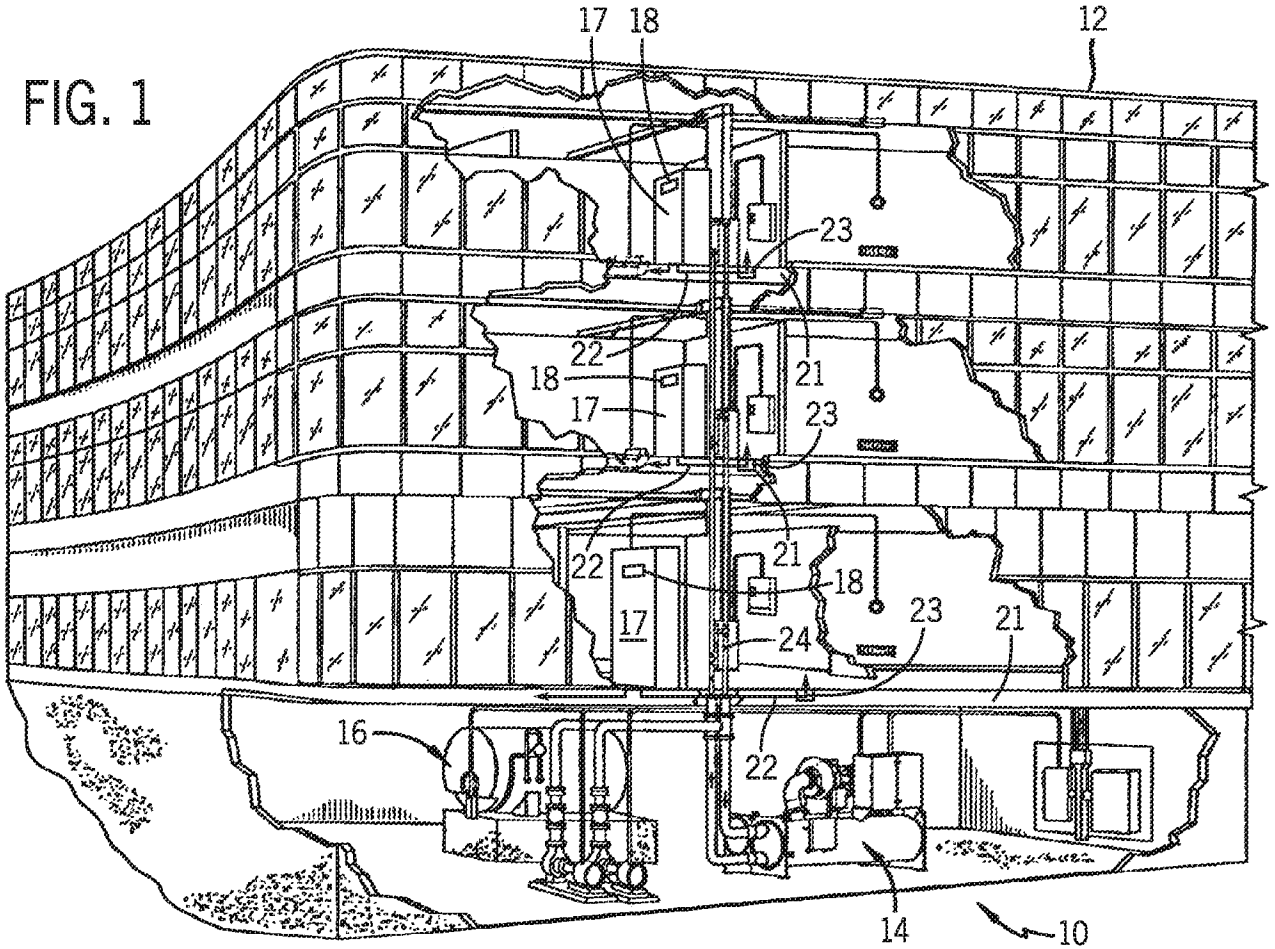
FIG. 1 is a perspective view of an embodiment of a building that may utilize a heating, ventilation, and/or air conditioning (HVAC) system in a commercial setting, in accordance with an aspect of the present disclosure.

Turning now to the drawings, FIG. 1 is a perspective view of an embodiment of a heating, ventilation, and/or air conditioning (HVAC) system 10 for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 12 may be serviced by the HVAC system 10. The building 12 may be a commercial structure or a residential structure. The HVAC system 10 may include a mechanical refrigeration system 14, such as a chiller, that supplies a chilled liquid, which may be used to cool air supplied to the building 12. The HVAC system 10 may also include a boiler 16 to supply warm liquid to heat air supplied to the building 12 and one or more air distribution systems 17, or air handling units, to condition air supplied to the building 12 with the chilled liquid provided by the mechanical refrigeration system 14 and/or the warm liquid provided by the boiler 16. In some embodiments, the air distribution system 17 may cool, heat, or otherwise condition air supplied to the building 12 in other manners, such as via a refrigerant circuit or other cooling/heating fluid circuit.

The air distribution system 17 may also circulate air through the building 12. In the illustrated embodiment, the air distribution system 17 includes an air return duct 18 configured to direct air from the building 12 into the air distribution system 17. The air distribution system 17 may be implemented to condition the air received from the air return duct 18 and to supply the conditioned air back out to the building 12. For example, the air distribution system 17 may direct the conditioned air through or beneath floors 21 of the building 12 in directions 22 within the floors 21. The conditioned air within the floors 21 may be directed to air diffusers 23 positioned within the floors 21. The air diffusers 23 may then distribute the conditioned air from the respective floors 21 into the conditioned spaces of the building 12.

In some embodiments, the air distribution system 17 may include a heat exchanger that is fluidly connected to the boiler 16 and/or the mechanical refrigeration system 14 by fluid conduits 24. The heat exchanger within the air distribution system 17 may receive warm liquid from the boiler 16 and/or chilled liquid from the mechanical refrigeration system 14, depending on a mode of operation of the HVAC system 10. For example, the air may be placed in thermal communication with warm liquid from the boiler 16 to be heated and/or the air may be placed in thermal communication with chilled liquid from the mechanical refrigeration system 14 to be cooled. Although FIG. 1 illustrates that the HVAC system 10 includes the mechanical refrigeration system 14 and the boiler 16 to condition air, it should be understood that the HVAC system 10 may include another heat exchanging apparatus to condition the air. Furthermore, it should be understood that heat exchangers of the HVAC system 10 may be positioned elsewhere, such as within each air distribution system 17, external to the building 12, or another suitable location.

The HVAC system 10 is shown with separate air distribution systems 17 on each floor of building 12, but in other embodiments, the HVAC system 10 may include air distribution systems 17 and/or other components that may be shared between or among each story of the building 12. Additionally, individual rooms of the building 12 may be associated with respective air distribution systems 17. Further, in some embodiments, the air distribution system 17 may be positioned on a ground of each room, mounted to a ceiling of each room, mounted to a wall of each room, disposed within a closet or other space adjacent to each room, and so forth.

Figure 2:
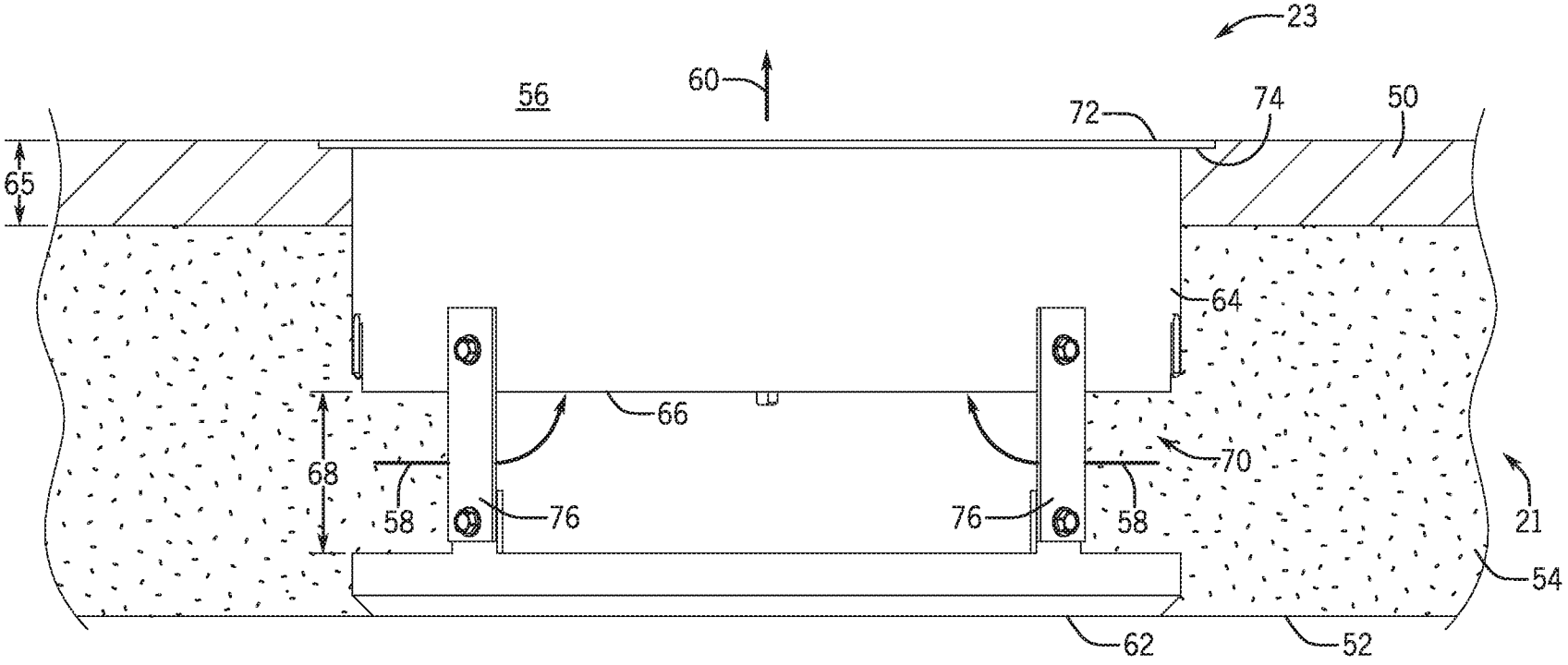
FIG. 2 is a partial cross-sectional side view of an embodiment of an air diffuser disposed within a floor, in accordance with an aspect of the present disclosure.

FIG. 2 is a partial cross-sectional side view of an embodiment of the air diffuser 23 disposed within the floor 21. The floor 21 may be a raised floor structure that has a slab 50, such as a concrete slab, positioned above a floor ground 52 to form a passageway 54 between the slab 50 and the floor ground 52 through which air may flow. The floor 21 may be used in applications such as data centers, in which equipment, such as servers, may be positioned in a space 56 atop the slab 50, and electrical connections, such as wiring and cables, may be routed through the passageway 54 to provide a greater availability of useable area in the space 56.

The floor 21 may have an opening in which the air diffuser 23 may be positioned to be in an installed position within the floor 21. Thus, the air diffuser 23 may be an under floor diffuser configured to direct an air flow, such as air conditioned received from the air distribution systems 17, from within the floor 21 out to the space 56. For example, air may be drawn and/or forced into the air diffuser 23 in a direction 58 through the passageway 54, and the air diffuser 23 may then discharge the air flow in a direction 60 away from the floor 21. In some implementations, in the installed position, the air diffuser 23 may include a drip tray 62 disposed atop or adjacent to the floor ground 52. The drip tray 62 may catch elements or particles, such as condensation and/or dust, which may be released by the air flow as the air flow travels through the air diffuser 23. The drip tray 62 may also catch items inadvertently dropped through the air diffuser 23 from the space 56.

The air diffuser 23 may also include a sleeve 64 extending through a thickness 65 of the slab 50 and into the passageway 54. The sleeve 64 may enable the air flow to be directed through the air diffuser 23 and out of the floor 21 in the direction 60. As illustrated in FIG. 2, a first end 66 of the sleeve 64 and the drip tray 62 may be separated by a distance 68 to form a plurality of inlet passages 70 through which the air flow may be directed from the passageway 54 to enter the air diffuser 23. Additionally, in the installed position, a second end 72 of the sleeve 64 may be exposed to the space 56 above the slab 50, such that air flowing through the sleeve 64 is directed to the space 56. In some embodiments, the second end 72 may include a lip 74 that may abut against the opening of the floor 21, such as within a recess of the slab 50, to facilitate installation of the air diffuser 23 in the floor 21. In this manner, the air diffuser 23 may be installed flush with the slab 50 of the floor 21.

The air diffuser 23 may additionally include a plurality of connectors 76 configured to couple the sleeve 64 with the drip tray 62. In certain embodiments, the size of each inlet passage 70 may be cooperatively defined by the drip tray 62, the sleeve 64, and the connectors 76. As such, the connectors 76 may be selected to provide inlet passages 70 of a particular size, which may affect an amount, such as a volumetric rate, of air flow that may be received by the air diffuser 23. For example, utilization of connectors 76 having a longer length may increase the distance 68, and therefore the size of each inlet passage 70, which may increase the amount or rate of air flow that may be received by the air diffuser 23.

Figure 3:
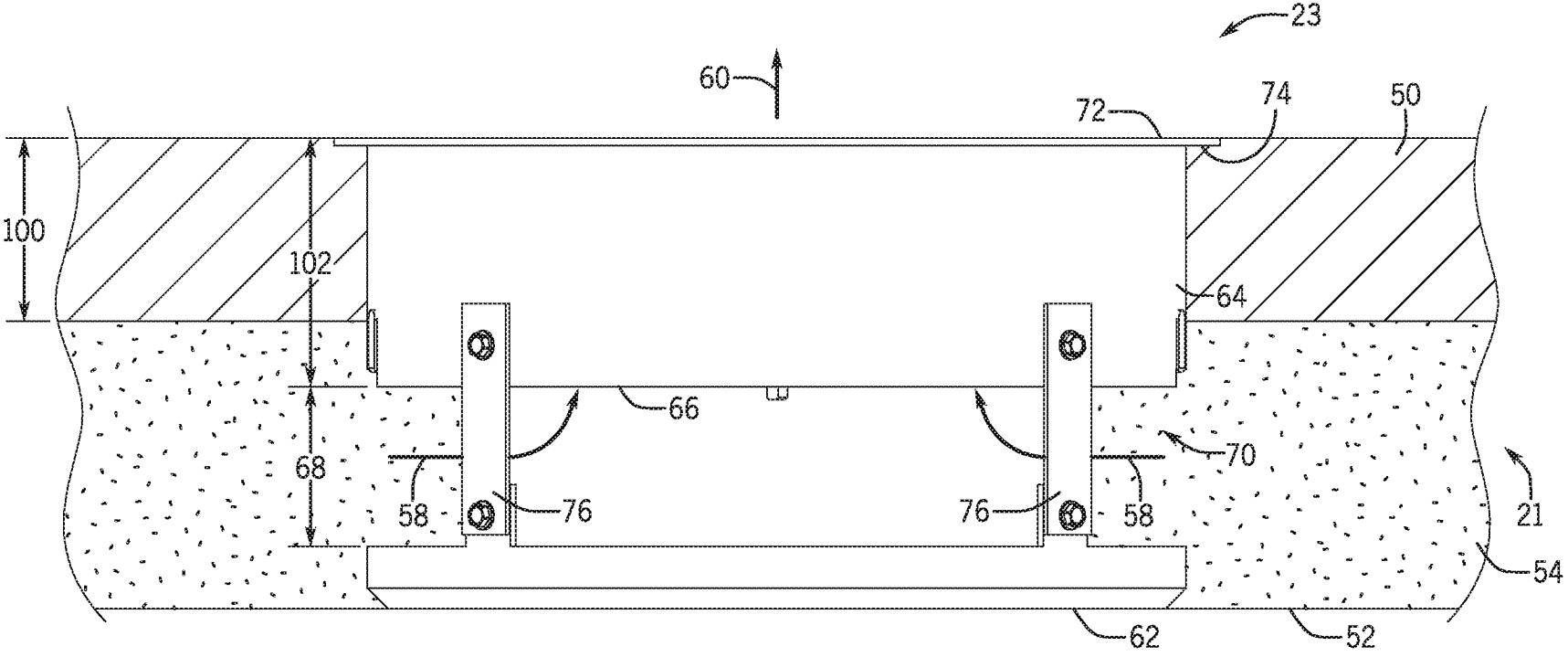
FIG. 3 is a partial cross-sectional side view of the air diffuser of FIG. 2 disposed within another floor, in accordance with an aspect of the present disclosure.

FIG. 3 illustrates a partial cross-sectional view of the air diffuser 23 of FIG. 2 disposed within another floor 21. In FIG. 3, a thickness 100 of the slab 50 is greater than the thickness 65 of the slab 50 in FIG. 2. However, due to a length 102 or depth of the sleeve 64, the slab 50 may not extend past or overlap with the inlet passages 70. Thus, the amount of air flow that may be received by and directed through the air diffuser 23 may not be limited by the thickness 100 of the slab 50. In some embodiments, the length 102 of the sleeve 64 and/or the size or length of the connectors 76 may be selected based on the thickness 100 of the slab 50 in addition to or instead of a desired magnitude of the distance 68 to form the inlet passages 70. For example, in an embodiment of the floor 21 in which the slab 50 has a greater thickness 100, an embodiment of the sleeve 64 having a greater length 102 and/or connectors 76 separating the sleeve 64 and the drip tray 62 by a greater distance 68 may be implemented in order to achieve a desired amount of air flow into the air diffuser 23. In certain implementations, the length 102 may be between 2.5 centimeters and 10 centimeters, or between about 1 inch and 4 inches.

Furthermore, the length 102 of the sleeve 64 may form a plenum chamber within the sleeve 64 that enables the air flow directed into the air diffuser 23 to be distributed within the sleeve 64 before the air diffuser 23 discharges the air flow in the direction 60 out of the air diffuser 23. For example, rather than flowing into and then immediately out of the sleeve 64, the air flow may flow into the sleeve 64 and mix with other incoming air flow within the plenum chamber along the length 102 to distribute the air flows throughout the plenum chamber, and the mixed and distributed air flows may thereafter flow out of the sleeve 64. By distributing the air flow within and throughout the sleeve 64, the air diffuser 23 may evenly and effectively distribute the air flow out of the air diffuser 23.

Figure 4:
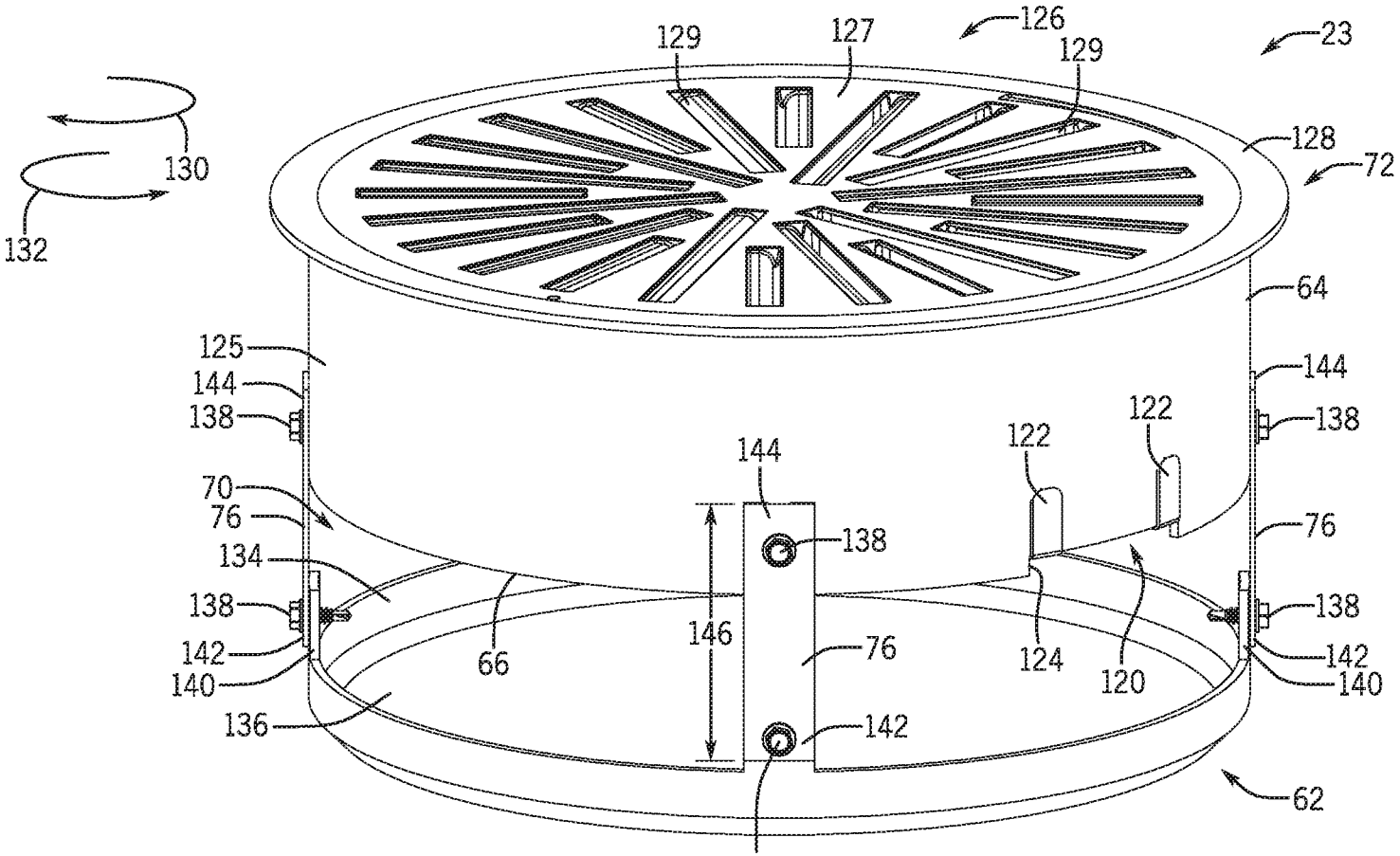
FIG. 4 is a perspective view of an embodiment of an air diffuser configured to be manually actuated to adjust an amount of air flow directed through the air diffuser, in accordance with an aspect of the present disclosure.

FIG. 4 is a perspective view of an embodiment of the air diffuser 23 configured to be manually actuated to adjust an amount of air flow directed through the air diffuser 23. Indeed, components of the air diffuser 23 may be adjusted to adjust or regulate a rate of air flow discharged from the air diffuser 23. In particular embodiments, the air diffuser 23 may include a damper 120 generally disposed within the sleeve 64 and configured to change an area of an opening through which the air flow may travel into and through the sleeve 64. For example, the damper 120 may be actuated to increase the area of the opening to increase the amount of air flow directed into the sleeve 64 and through the air diffuser 23, or the damper 120 may be actuated to decrease the area of the opening to decrease the amount of air flow directed into the sleeve 64 and through the air diffuser 23.

The damper 120 may be coupled to the sleeve 64 adjacent to the first end 66. In FIG. 4, the damper 120 includes tabs 122 to facilitate coupling the damper 120 onto the sleeve 64. For example, the sleeve 64 may include a recess 124 formed in the first end 66 and into which the tabs 122 may be inserted. The tabs 122 may be located on opposite ends of the damper 120 and, upon attaching the damper 120 onto the sleeve 64, the tabs 122 may impart a compressive force, such as a radial force, onto an outer surface 125 of the sleeve 64 to fasten the damper 120 onto the sleeve 64. Although the illustrated embodiment depicts two tabs 122 at each end of the damper 120, the damper 120 may have any suitable number of tabs 122 to facilitate coupling of the damper 120 to the sleeve 64. In additional or alternative embodiments, the damper 120 may be coupled to the sleeve 64 in another manner, such as via fasteners, welds, adhesives, hooks, and the like.

The air diffuser 23 includes a diffuser face 126 or discharge face disposed at the second end 72 of the sleeve 64, such that the plenum chamber formed within the sleeve 64 spans from the damper 120 at the first end 66 to the diffuser face 126 at the second end 72. Although FIG. 4 depicts the sleeve 64, the diffuser face 126, and the drip tray 62 as having an approximately circular shape, in other embodiments, the sleeve 64, the diffuser face 126, and the drip tray 62 may have another suitable geometry. Furthermore, in an installed configuration of the air diffuser 23, the diffuser face 126 is disposed within the sleeve 64 such that a first axial surface 127 of the diffuser face 126 may be substantially flush with a second axial surface 128 of the second end 72 of the sleeve 64. In this manner, in an installed position in which the air diffuser 23 is installed in the floor 21, the first axial surface 127 of the diffuser face 126 may also be exposed to the space 56. Additionally, the first axial surface 127 and the second axial surface 128 may be substantially flush with the slab 50 of the floor 21. The diffuser face 126 may include a plurality of face openings 129 to enable the air flow to travel out of the sleeve 64. In some embodiments, the overall area of face openings 129 that enables air flow out of the sleeve 64 may be smaller than an area of the opening formed by the damper 120 that enables air flow into the sleeve 64. Thus, the air flow drawn into the air diffuser 23 may pressurize within the plenum chamber and at least partially fill the plenum chamber to distribute across the first axial surface 127 of the diffuser face 126. As such, the air flow may be forced out of each face opening 129 at approximately the same volumetric flow rate.

In some embodiments, the diffuser face 126 may be rotatably coupled to the sleeve 64, whereby rotation of the diffuser face 126 may actuate the damper 120. For example, the diffuser face 126 may be turned or rotated in a first rotational direction 130 and in a second rotational direction 132 relative to the sleeve 64 in order adjust a position of the damper 120 and to increase or decrease the area of the opening to an air flow passage, such as at the second end 72, of the sleeve 64. The diffuser face 126 may be rotated manually, such as via a user of the air diffuser 23, and/or by an actuator, such as via a controller.

Furthermore, the illustrated embodiment of the drip tray 62 of the air diffuser 23 may include a side wall 134 surrounding and extending away from a pan 136 of the drip tray 62. The pan 136 may catch particles, such as moisture droplets, released by the air flow, and the side wall 134 may block the particles from flowing out of the pan 136. Thus, the particles released by the air flow may be contained within the drip tray 62 and are blocked from flowing elsewhere in the floor 21, such as into the passageway 54, during operation of the air diffuser 23.

As illustrated in FIG. 4, each connector 76 is coupled to the sleeve 64 and to the drip tray 62 via fasteners 138. Although FIG. 4 depicts the air diffuser 23 as having a certain number of connectors 76, other embodiments of the air diffuser 23 may have another suitable number of connectors 76. In particular implementations, the side wall 134 may include protrusions 140, in which a first connector end 142 of one of the connectors 76 may be coupled to one of the protrusions 140. Furthermore, a second connector end 144 of each connector 76 may be coupled to the outer surface 125 of the sleeve 64. As mentioned herein, the size of the connectors 76, such as a connector length 146, may be selected to adjust the distance 68 and the size of the inlet passages 70. In certain embodiments, the connector length 146 may be adjusted by utilizing different connectors 76 with the air diffuser 23. In other words, the connectors 76 may be removably coupled to the sleeve 64 and/or to the drip tray 62 to enable the connectors 76 to be removed and to enable different connectors 76 having a different connector length 146 to be utilized. In additional or alternative embodiments, each connector 76 may include several legs that join together, in which the legs may slide or transition relative to one another to enable each connector 76 to extend and retract to adjust the connector length 146. In such embodiments, the connectors 76 may be permanently coupled to the sleeve 64 and/or to the drip tray 62, such as via welds and/or adhesives, or the connectors 76 may be directly formed onto the sleeve 64 and/or onto the drip tray 62.

Figure 5:
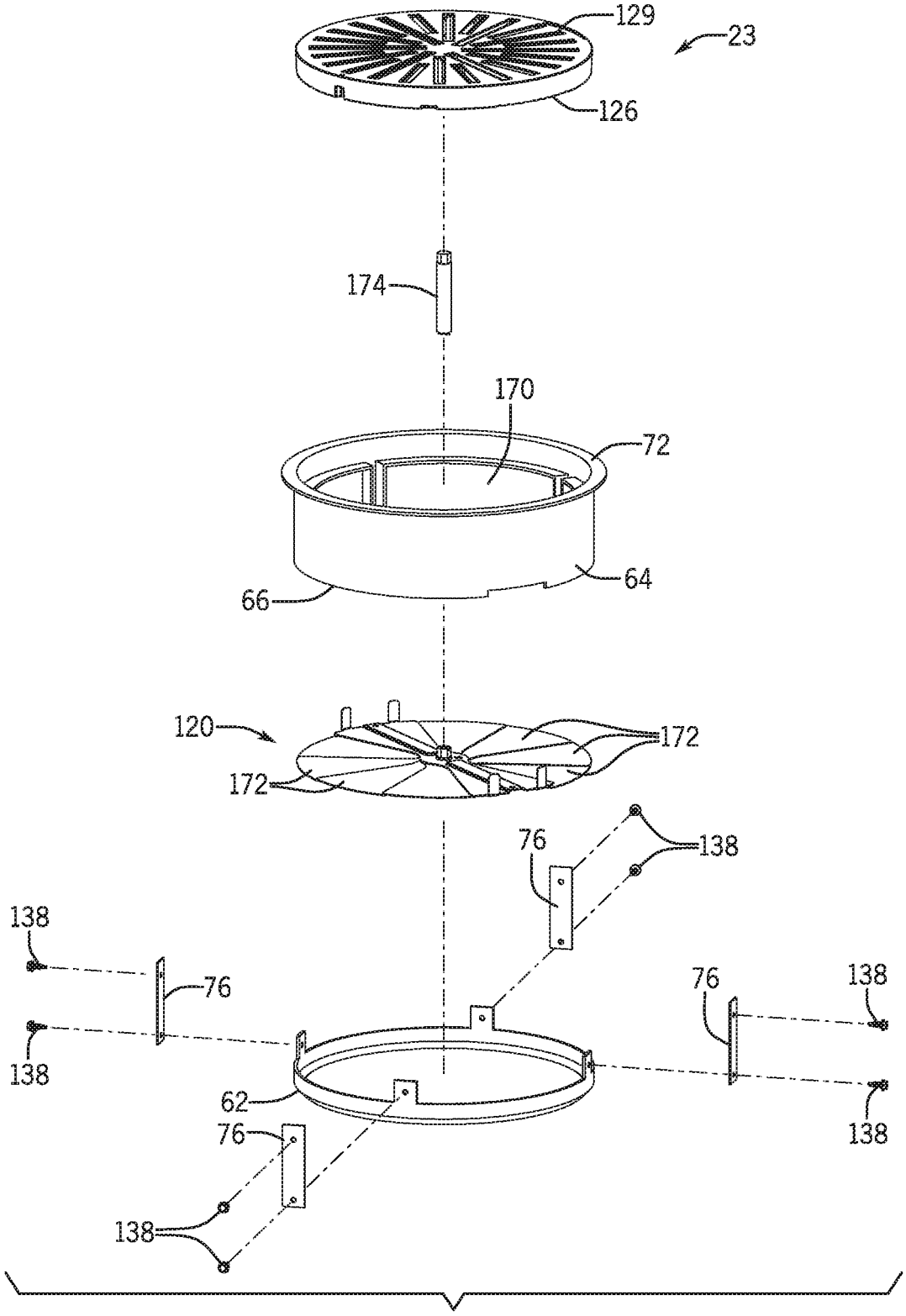
FIG. 5 is an exploded perspective view of the air diffuser of FIG. 4 in a closed position to block air flow through the air diffuser, in accordance with an aspect of the present disclosure.

FIG. 5 is an exploded perspective view of the air diffuser 23 of FIG. 4, illustrating the damper 120 in a closed position to block the air flow from traveling through the air diffuser 23. As shown in FIG. 5, the sleeve 64 includes an air flow passage 170 extending from the first end 66 to the second end 72 of the sleeve 64. Further, the damper 120 includes a plurality of damper sections 172 that may be adjusted to block and/or enable air flow through the air flow passage 170. Specifically, the position of the damper sections 172 may be adjustable to change the area of an opening into the air flow passage 170 through which the air flow may travel from the inlet passages 70. For example, rotation of the damper 120 may adjust the position of the damper sections 172 relative to one another, such as to stack the damper sections 172 atop one another and increase the area of the opening to the air flow passage 170 to enable the air flow to travel into the sleeve 64. In the closed position depicted in FIG. 5, the damper sections 172 are positioned to substantially match the geometric area of the air flow passage 170, which is shown as a generally circular shape, to block the air flow from traveling through the air diffuser 23. In other words, in the illustrated closed configuration, the damper sections 172 are positioned adjacent to one another about a circumference of the sleeve 64, such that the damper sections 172 are not stacked atop one another. In this manner, the damper sections 172 occlude the air flow path between the inlet passages 70 and the air flow passage 170 to block air flow into the sleeve 64. In alternate embodiments, the damper sections 172 may be positioned in another suitable shape to match the geometry of the air flow passage 170 and to block the air flow from traveling through the air diffuser 23.

In certain implementations, the air diffuser 23 may include a damper connector 174 to enable rotation of the damper 120. In the illustrated embodiment, the damper connector 174 is configured to couple the damper 120 to the diffuser face 126. The damper connector 174 may enable rotation of the damper 120 via rotation of the diffuser face 126. In other words, a user may manually rotate the diffuser face 126, and the rotational motion of the diffuser face 126 may be transferred to the damper 120, and therefore the damper sections 172, via the damper connector 174. In this manner, the position of the damper sections 172 may be manually adjusted. Thus, the damper connector 174 may enable rotation of the diffuser face 126 to adjust the amount or rate of air flow that may travel through the air diffuser 23. In such implementations, the user may manually rotate the diffuser face 126, such as via engagement with one of the face openings 129, in order to adjust the air flow through the air diffuser 23.

Figure 6:
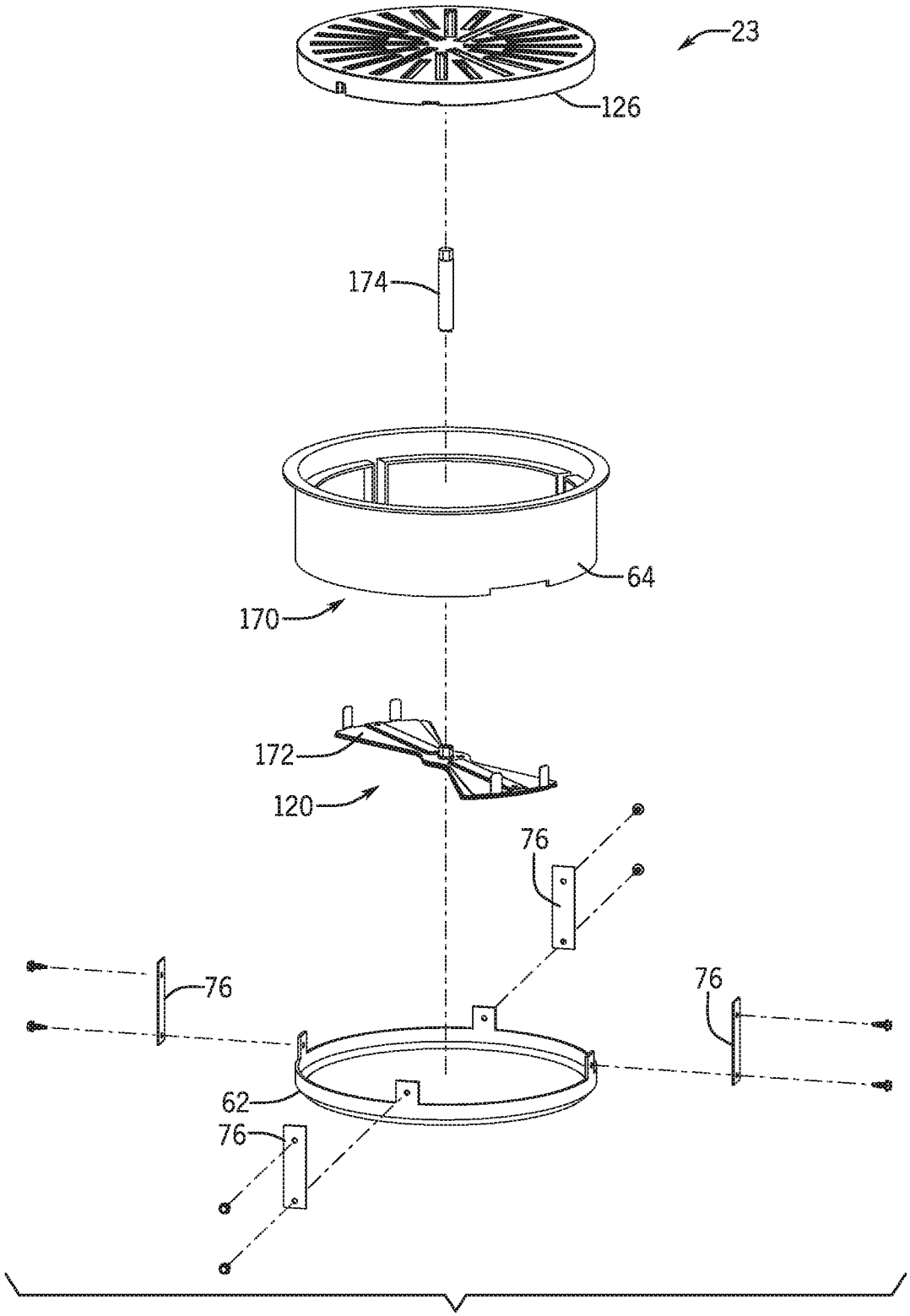
FIG. 6 is an exploded perspective view of the air diffuser of FIGS. 4 and 5 in a fully open position to enable air flow through the air diffuser, in accordance with an aspect of the present disclosure.

FIG. 6 is an exploded perspective view of the air diffuser 23 of FIGS. 4 and 5, illustrating the damper 120 in a fully open position to enable the air flow to travel through the air diffuser 23. As illustrated in the fully open position of FIG. 6, the damper 120 is rotated, such that a majority of the damper sections 172 are stacked atop one another to form a bow-tie shape, thereby opening the damper 120 to enable the air flow to be directed through the air flow passage 170 of the sleeve 64. Indeed, each damper section 172 may have a bow-tie shape or configuration, and the bow-tie shape of each damper section 172 may overlap with the bow-tie shape of the other damper sections 172 when the damper 120 is in the fully open position shown.

In certain embodiments, the damper sections 172 may be configured to rotate relative to one another to adjust the area of the opening to the air flow passage 170 between approximately 0 percent and 90 percent open. In other words, at 0 percent open, which may be considered the closed position of the damper 120, the damper sections 172 of the damper 120 generally cover the entire area of the opening to the air flow passage 170 and thereby block substantially all air flow into the sleeve 64. At 90 percent open, which may be considered the fully open position of the damper 120, the damper sections 172 of the damper 120 generally cover approximately 10 percent of the opening to the air flow passage 170 to enable a greater amount of air flow through the sleeve 64. Additionally, the damper sections 172 may be positioned, via rotation of the damper sections 172 to increase or decrease the overlap between the damper sections 172, to place the air diffuser 23 in a partially open position, in which the size or area of the opening to the air flow passage 170 may be any percentage between 0 percent and 90 percent open, such as 25 percent open, 50 percent open, 75 percent open, and so forth.

In some embodiments, the sleeve 64, the connectors 76, the damper 120, the diffuser face 126, and/or the damper connector 174 may be formed from a metal, such as aluminum and/or galvanized steel, a composite, and/or a plastic material to maintain a structural integrity of the air diffuser 23. Additionally, the sleeve 64, the connectors 76, the damper 120, the diffuser face 126, and/or the damper connector 174 may be formed from the same material or from different materials.

Figure 7:
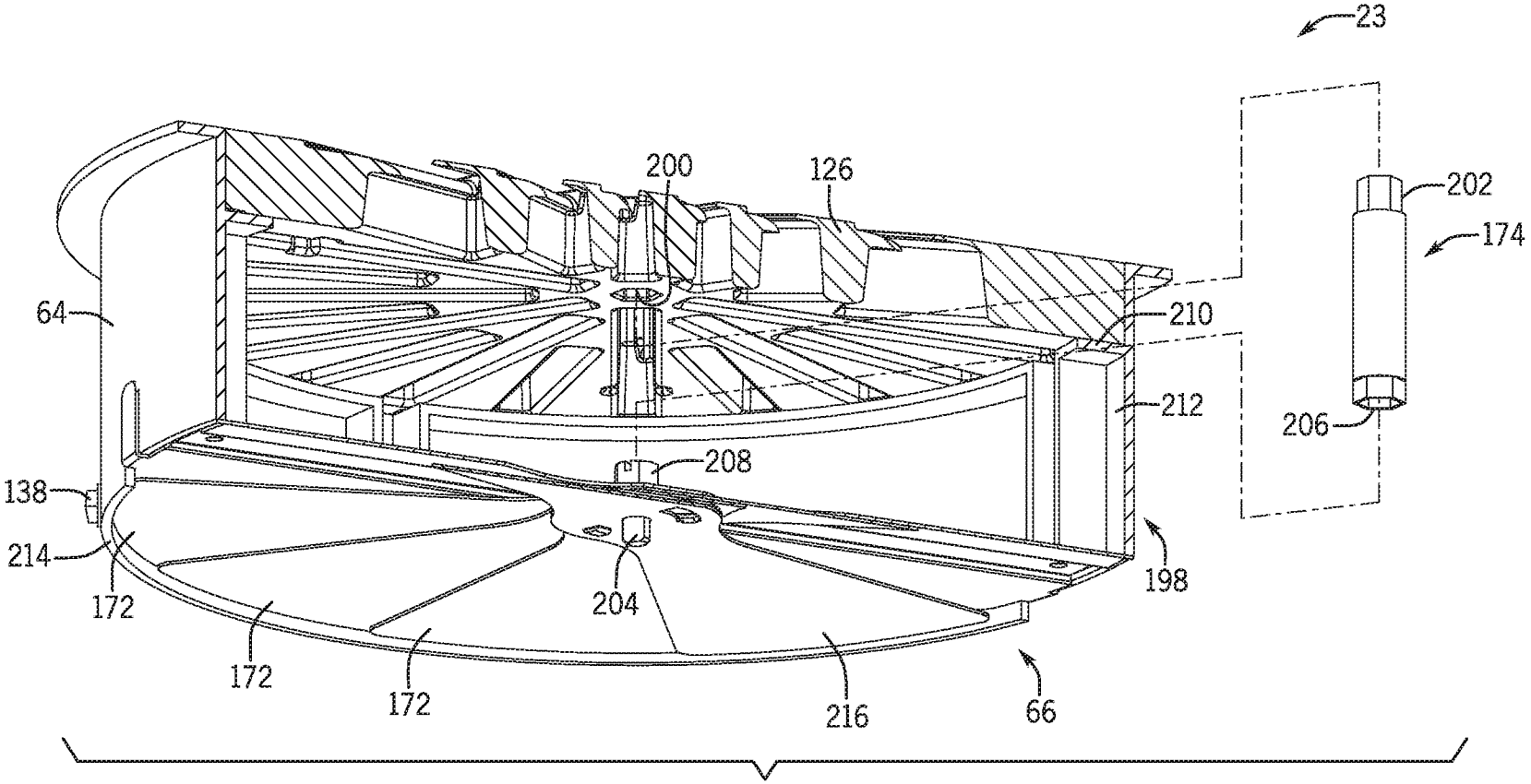
FIG. 7 is a cross-sectional perspective view of the air diffuser of FIGS. 4-6, illustrating a damper connector of the air diffuser, in accordance with an aspect of the present disclosure.

FIG. 7 is a cross-sectional perspective view of the air diffuser 23 of FIGS. 4-6, illustrating the damper connector 174. As illustrated in FIG. 7, a plenum chamber 198 is defined within the sleeve 64 between the damper 120 and the diffuser face 126. To couple the diffuser face 126 to the damper 120, the damper connector 174 may extend through the plenum chamber 198 in the installed configuration of the air diffuser 23. In the illustrated implementation, the diffuser face 126 may include a recess 200, into which a first damper connector end 202 may extend. By way of example, the recess 200 may include a geometry, such as a flat shape, a rectangular shape, a hexagonal shape, and so forth, and the first damper connector end 202 may be shaped to match the geometry of the recess 200. As such, the damper connector 174 may be rotationally fixed relative to the diffuser face 126. That is, rotation of the recess 200, will impart a torque on the first damper connector end 202 to rotate the damper connector 174 such that the damper connector 174 does not rotate relative to the diffuser face 126. Rather, an amount of rotation of the diffuser face 126 causes the same amount of rotation of the damper connector 126.

Additionally, the damper 120 may include a damper fastener 204 inserted through a center of the damper 120, such as through a particular one of the damper sections 172, whereby rotation of the damper fastener 204 rotates the particular damper section 172 to adjust the size of the opening to the air flow passage 170. Rotation of the particular damper section 172 may then cause rotation of other damper sections 172 of the damper 120. A second damper connector end 206 may be configured to engage with the damper fastener 204, such that rotation of the damper connector 174 rotates the damper fastener 204 and, thus, rotates the particular damper section 172. For instance, the damper fastener 204 may include a head 208 having an outer surface with a particular geometry or shape, and the second damper connector end 206 may have another recess having with a similar geometry or shape to enable the head 208 to insert into the second damper connector end 206. The recess of the second damper connector end 206 may be shaped such that rotation of the damper connector 174 imparts a torque onto the head 208 to rotate the damper fastener 204 and the particular damper section 172. That is, the damper connector 174 may be rotationally fixed relative onto the damper 120, such that an amount of rotation of the damper 120 causes the same amount of rotation of the damper section 172. As such, rotational motion of the diffuser face 126 is transferred to the damper sections 172 via the damper connector 174 in order to adjust the size of the opening to the air flow passage 170, which adjusts an amount or rate of air flow that may travel through the sleeve 64.

In particular embodiments, the diffuser face 126 may be removably coupled to the sleeve 64. For example, the sleeve 64 may include a shoulder 210 formed in an inner surface 212 of the sleeve 64. The diffuser face 126 may be configured to insert into the sleeve 64 and abut the shoulder 210. Thus, the inner surface 212 secures the diffuser face 126 within the sleeve 64, and the diffuser face 126 may slidably rotate within the sleeve 64 along the shoulder 210. When the diffuser face 126 abuts the shoulder 210 and when the damper connector 174 is positioned within the plenum 198 and is aligned with the recess 200, the first connector end 202 may be inserted into the recess 200. In some implementations, the diffuser face 126 may slip fit into the sleeve 64, and the first connector end 202 may slip fit into the recess 200 of the diffuser face 126. As such, the diffuser face 126 may be easily removed from the sleeve 64 without additional equipment, so as to provide access to the air flow passage 170 and/or the drip tray 62 from above the slab 50 and the floor 21.

Moreover, as illustrated in FIG. 7, when coupled to the sleeve 64, the damper 120 may be radially offset from an outermost edge 214 of the sleeve 64 at the first end 66. That is, a damper surface 216 of each damper section 172 may be located between the outermost edge 214 and the diffuser face 126 along a flow path of the air flow through the air diffuser 23. As such, each damper surface 216 may be fully contained within the sleeve 64 to enable the respective damper sections 172 to block the air flow from entering the sleeve 64. Moreover, the position of each damper section 172 within the sleeve 64 may avoid contact with the fasteners 138 coupling the respective connectors 76 to the sleeve 64.

FIG. 8 is a perspective view of an embodiment of the air diffuser 23 configured to be actuated via an actuator 240 in order to adjust an amount of air flow directed through the air diffuser 23. In the illustrated embodiment, the actuator 240 is positioned on a side 242 of the drip tray 62 opposite the inlet passages 70. Thus, the actuator 240 does not block the air flow directed through the inlet passages 70. Moreover, in the illustrated position of the actuator 240, the drip tray 62 may block emissions or particles, such as condensate, from the air flow from contacting the actuator 240, which may affect a performance or an operation of the actuator 240.

Additionally, the damper connector 174 may couple the actuator 240 with the damper 120. The actuator 240 may be configured to rotate the damper connector 174, which thereby rotates the damper 120 and the damper sections 172 to adjust a size of the opening of the damper 120 and therefore adjust the amount of air flow directed through the damper 23. In certain embodiments, the actuator 240 may be communicatively coupled to a controller 244 configured to instruct the actuator 240 to rotate the damper connector 174. The controller 244 may include a memory 246 and a processor 248. The memory 246 may be a mass storage device, a flash memory device, a removable memory, or any other non-transitory computer-readable medium that includes instructions regarding control of the actuator 240. The memory 246 may also include volatile memory, such as randomly accessible memory (RAM), and/or non-volatile memory, such as hard disc memory, flash memory, and/or other suitable memory formats. The processor 248 may execute the instructions stored in the memory 246, such as instructions to adjust the operation of the actuator 240. As an example, the controller 244 may instruct the actuator 240 to adjust the damper 120 based on a user input, which may indicate a desired air flow rate and/or a desired increase or decrease to a current air flow rate through the air diffuser 23. In another example, the controller 244 may instruct the actuator 240 to adjust a position of the damper 120 based on an operating parameter. To this end, the controller 244 may be communicatively coupled to a sensor 250 configured to detect the operating parameter. For instance, the operating parameter may include a temperature of the air flow, a temperature of the environment conditioned by air discharged from the air diffuser 23, a current air flow rate, a time, another suitable operating parameter, or any combination thereof.

FIG. 9 is an exploded perspective view of the air diffuser 23 of FIG. 8 configured to be actuated via the actuator 240 to adjust the amount of air flow directed through the air diffuser 23. As shown in FIG. 9, the damper connector 174 may be configured to extend from the actuator 240 and through the drip tray 62, instead of through the sleeve 64, to couple the actuator 240 to the damper 120. For example, the actuator 240 may include a wheel 270, whereby activation of the actuator 240 may rotate or spin the wheel 270. The drip tray 62 may include an opening or hole 272 through which the wheel 270 may extend to couple to the damper connector 174. The second damper connector end 206 of the damper connector 174 may additionally or alternatively extend through the hole 272 to couple to the wheel 270. In some embodiments, the second damper connector end 206 may include a recess or an extension shaped to match the geometry of the wheel 270, such that engagement between the second damper connector end 206 and the wheel 270 enables transfer of rotational motion from the wheel 270 to the damper connector 174. Similarly, a geometry of the first damper connector end 202 may match or conform to the geometry of the damper fastener 204, such that rotation of the damper connector 174 also rotates the damper fastener 204 to adjust the position of the damper 120. As such, rotation of the wheel 270 may rotate the damper 120 to adjust the opening to the air flow passage 170 and change the amount of air flow directing through the air diffuser 23.

Embodiments of the present disclosure may provide one or more technical effects useful in the operation of air distribution systems, which may be associated with an HVAC system. For example, the air distribution system may direct air into a space via a diffuser disposed within a floor of the space. The diffuser may include inlet passages formed by a sleeve, a drip tray, and connectors coupling the sleeve to the drip tray, where the inlet passages receive an air flow directed by the air distribution system. The dimensions of the sleeve and the connectors may be selected based on a structure of the floor to enable a desired amount of air flow into the inlet passages. The diffuser may further include a plenum chamber defined by the sleeve, a damper, and a diffuser face to enable even distribution of the air flow within the plenum chamber and therefore even distribution of the air flow into the space from the diffuser. Thus, the performance of the diffuser in distributing the air flow into the space may be improved and may not depend on the structure of the floor. Additionally, the damper may be configured to adjust an amount or a rate at which the air flow may be directed through the diffuser. In certain embodiments, the damper may be adjusted manually and/or via a controller, and an implementation of the diffuser may be selected based on a desired operation of the diffuser. The technical effects and technical problems in the specification are examples and are not limiting. It should be noted that the embodiments described in the specification may have other technical effects and can solve other technical problems.

While only certain features and embodiments of the disclosure have been illustrated and described, many modifications and changes may occur to those skilled in the art, such as variations in sizes, dimensions, structures, shapes and proportions of the various elements, values of parameters, including temperatures, pressures, and so forth, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. An air diffuser configured to be positioned in a floor, the air diffuser comprising:

a sleeve having a first end and a second end with an air flow passage extending through the sleeve from the first end to the second end;

a diffuser face disposed at the first end of the sleeve and configured to be exposed to an environment in an installed position within the floor;

a damper disposed at and in contact with an edge of the second end of the sleeve; and a plenum chamber defined within the sleeve between the damper and the diffuser face, wherein the air flow passage extends through the plenum chamber.

2. The air diffuser of claim 1, wherein the sleeve has an outer surface, and the air diffuser includes a drip tray coupled to the sleeve via connectors coupled to the outer surface at the second end.

3. The air diffuser of claim 2, wherein the air flow passage is configured to direct an air flow through the air diffuser, and wherein the sleeve, the connectors, and the drip tray cooperatively define a plurality of inlet passages configured to receive the air flow into the air diffuser.

4. The air diffuser of claim 2, comprising an actuator coupled to a side of the drip tray opposite the sleeve, wherein the actuator is coupled to the damper via a damper connector extending through the drip tray, and wherein the actuator is configured to adjust a position of the damper.

5. The air diffuser of claim 4, wherein the actuator is configured to rotate the damper connector to adjust the position of the damper.

6. The air diffuser of claim 4, comprising a controller communicatively coupled to the actuator, wherein the controller is configured to instruct the actuator to adjust the position of the damper.

7. The air diffuser of claim 2, wherein the drip tray includes a pan and a wall surrounding and extending away from the pan, the wall includes a plurality of protrusions, and each connector is configured to couple to a respective protrusion of the plurality of protrusions.

8. The air diffuser of claim 1, wherein the sleeve includes a shoulder formed in an inner surface of the sleeve, and the diffuser face abuts the shoulder.

9. The air diffuser of claim 1, wherein the first end of the sleeve includes a first axial surface, the diffuser face includes a second axial surface, and the first and second axial surfaces are substantially flush in the installed position.

10. The diffuser of claim 1, wherein the damper and the diffuser face are offset from one another to define a volume of the plenum chamber configured to enable pressurization and distribution of an air flow within the plenum chamber.

11. An air diffuser configured to be positioned in a floor, the air diffuser comprising:

a sleeve having a first end and a second end;

a diffuser face disposed at the first end of the sleeve and configured to be exposed to a conditioned space in an installed position within the floor;

a damper disposed at the second end of the sleeve and including a plurality of damper sections configured to adjustably block an opening of the second end to regulate a rate of air flow into the sleeve, wherein each damper section of the plurality of damper sections is rotatable relative to one another, and the damper abuts an edge of the second end of the sleeve; and a plenum chamber defined within the sleeve between the damper and the diffuser face.

12. The air diffuser of claim 11, wherein each damper section of the plurality of damper sections has a bow-tie shape.

13. The air diffuser of claim 11, wherein the plurality of damper sections is configured to overlap with one another in an open position of the damper.

14. The air diffuser of claim 11, comprising a damper connector extending between the diffuser face and a damper section of the plurality of damper sections, wherein the damper connector is rotationally fixed relative to the diffuser face and the damper section.

15. The air diffuser of claim 11, comprising a drip pan configured to be positioned beneath the sleeve in the installed position.

16. The air diffuser of claim 15, comprising a plurality of connectors coupled to the drip pan and to the second end of the sleeve to offset the drip pan from the sleeve and form a plurality of inlet passages of the air diffuser.

17. The air diffuser of claim 15, comprising an actuator coupled to a side of the drip pan opposite the sleeve, and comprising a damper connector extending through the drip pan and between the damper and the actuator, wherein the actuator is configured to rotate the damper connector to adjust respective positions of the plurality of damper sections relative to one another to adjustably block the opening of the second end of the sleeve.

18. An air diffuser configured to be positioned in a floor, the air diffuser comprising:

a sleeve having a first end and a second end with an air flow passage extending through the sleeve from the first end to the second end;

a diffuser face coupled to the sleeve at the first end;

a damper in abutment with an edge of the sleeve at the second end to define a plenum chamber within the sleeve between the damper and the diffuser face, wherein the air flow passage extends through the plenum chamber; and a damper connector extending through the plenum chamber and coupled to the damper and to the diffuser face, wherein the damper connector is configured to enable adjustment of a position of the damper via rotation of the diffuser face.

19. The air diffuser of claim 18, wherein the diffuser face is configured to be exposed to a conditioned space in an installed position of the air diffuser within the floor, and the diffuser face is removable from the sleeve and the damper connector in the installed position.

20. The air diffuser of claim 19, wherein the diffuser face includes a recess, an end of the damper connector is configured to extend into the recess, and the end and the recess have matching geometries.

21. The air diffuser of claim 20, wherein the end is a first end, the damper includes a damper fastener, and a second end of the damper connector is configured to engage with the damper fastener.

22. The air diffuser of claim 18, wherein the damper includes a plurality of damper sections that are rotatably adjustable relative to one another to adjust the position of the damper.

23. The air diffuser of claim 18, wherein the sleeve includes a shoulder formed in an inner surface of the sleeve, wherein the diffuser face abuts the shoulder in an installed configuration, and wherein the diffuser face is configured to slidably rotate along the shoulder to adjust the position of the damper.

24. The air diffuser of claim 18, wherein the damper includes tabs configured to impart a compressive force onto an outer surface of the second end of the sleeve to couple the damper to the edge of the sleeve at the second end.

* * * * *